United States Patent [19]

Friedel et al.

[11] Patent Number: 4,468,800

[45] Date of Patent: Aug. 28, 1984

[54] ROTARY ANODE X-RAY TUBE

[75] Inventors: Rudolf Friedel, Kleinseebach; Ernst Geldner, Weiher, both of Fed. Rep. of Germany

[73] Assignee: Siemens Aktiengesellschaft, Berlin & Munich, Fed. Rep. of Germany

[21] Appl. No.: 270,366

[22] Filed: Jun. 4, 1981

[30] Foreign Application Priority Data

Jun. 16, 1980 [DE] Fed. Rep. of Germany ..... 3022618

[51] Int. Cl.[3] ..... H01J 35/04

[52] U.S. Cl. ..... 378/131; 378/132; 378/144

[58] Field of Search ..... 378/144, 131, 132

[56] References Cited

U.S. PATENT DOCUMENTS 3,894,239 7/1975 Braun ..... 378/144

4,167,671 9/1979 Boden ..... 378/131

*Primary Examiner*—Craig E. Church

*Attorney, Agent, or Firm*—Hill, Van Santen, Steadman & Simpson

[57] ABSTRACT

In exemplary embodiments, the anode is driven by an induction motor, between the stator and rotor of which the wall of the vacuum envelope of the tube is disposed. To reduce the overall length and the lever actions of the weight of the anode which act on the bearing which are disadvantageous in this construction, the disclosure provides an annular anode which is disposed in the same plane with the drive rotor. The rotor and stator can here be surrounded by the ring of the anode or they can be secured externally about the latter. X-ray tubes in accordance with the disclosure are particularly suited for use for the purpose of medical x-ray examination.

9 Claims, 2 Drawing Figures

ROTARY ANODE X-RAY TUBE

BACKGROUND OF THE INVENTION

The invention relates to a rotary anode x-ray tube according to the preamble of patent claim 1. Such x-ray tubes are e.g. known from the German No. LP 1,099,095.

In the case of the prior-known x-ray tube, the anode is annularly designed in order to obtain an improvement in the thermal loading capacity. On the other hand, a bearing is laid in the plane of the annular dimension of the anode in order to reduce the lever action of the weight of the anode engaging on the bearings in the case of otherwise conventional rotary anode x-ray tubes. However, the anode arrangement is here still designed in the known manner such that the anode itself as well as its drive rotor are disposed adjacent one another on a shaft. This has the disadvantage that the overall length of such a tube becomes very great.

SUMMARY OF THE INVENTION

The object underlying the invention resides in attaining a compact tube construction in the case of a rotary anode x-ray tube according to the preamble of patent claim 1, by avoiding the above-cited disadvantages. In accordance with the invention, this object is achieved by the measures disclosed in the characterizing clause of claim 1. Advantageous further developments and expedient embodiments of the invention are the subject of the subclaims.

In the arrangement of the annular anode member and the drive motor in one plane, it is made possible that the tube overall length is only determined by the necessary bearing overall length.

Expedient embodiments result by virtue of the fact that the rotor as well as the stator of the drive motor can be arranged in the space enclosed by the annular member of the anode.

Another realization of the invention can be achieved in that the rotor and the stator of the drive motor surround (or enclose) the anode.

Further details and advantages of the invention shall be explained in the following on the basis of the exemplary embodiments illustrated in the Figures of the accompanying drawing sheet; and other objects, features and advantages will be apparent from this detailed disclosure and from the appended claims.

DETAILED DESCRIPTION

Figure 1:
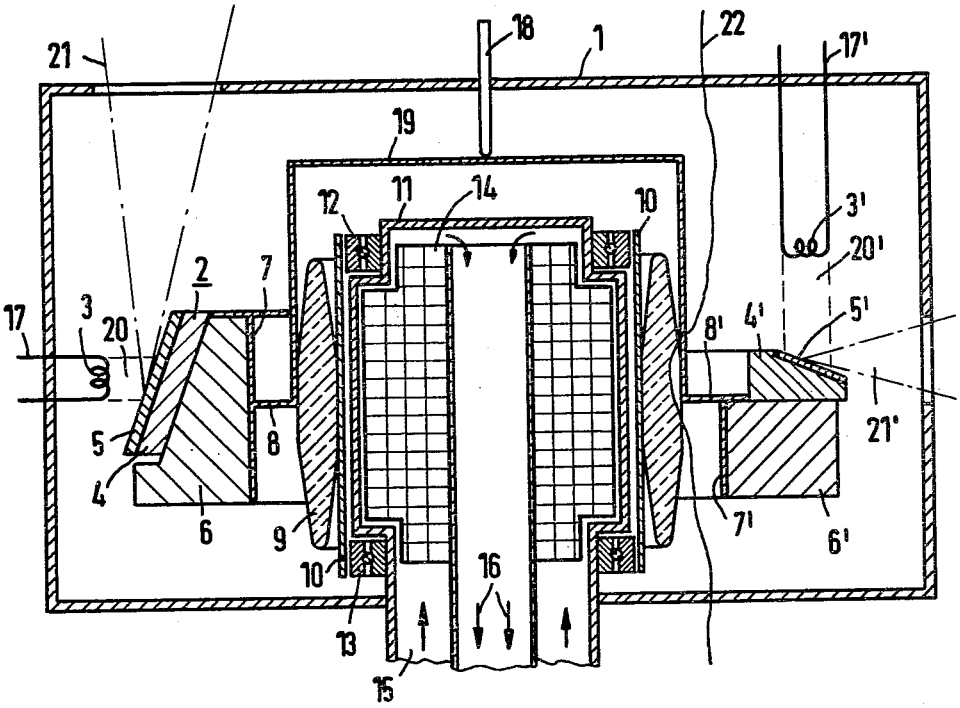
In FIG. 1 a cross section of an inventive rotary anode with a central drive motor is illustrated; and in FIG. 2 such a rotary anode is illustrated in which the motor is disposed at the periphery.

In FIG. 1, 1 designates a vacuum envelope which surrounds the anode 2 as well as the cathode 3. Whereas the latter is designed in a conventional fashion in the form of a thermionic cathode, the anode is formed of an annular member 4 consisting of a molybdenum alloy containing 5% tungsten (MoW5), which, at its exterior side, bears a coating 5 consisting of a tungsten alloy which contains 5 to 10% rhenium (WRe 5-10), which coating is 0.8 to 1.3 mm thick. The member 4 rests on a base 6 consisting of graphite. The base 6 is connected, via a tubular portion 7 and via a cross-piece 8 consisting of molybdenum or a tungsten-zirconium-molybdenum-alloy (Mo, TZM), with an annular part 9 consisting of ceramic. The latter bears, on its interior side, a section 10 consisting of Vacon which serves as a bearing bushing. In the interior of the section 10 there is a space formed by an inwardly-drawn section 11 of the envelope wall, which space exhibits annular steps of reduced diameter on which ball bearings 12 and 13 are secured, which serve as a bearing or collecting bearing for the anode 2 when the anode is magnetically mounted by means of the coils 14. The parts 14, moreover, additionally contain an integrated stator winding for the drive of the rotation of the anode 2, so that an additional stator is not necessary. As indicated by arrows 15 and 16, the volume of the magnetic bearing and the part acting as stator is cooled by means of oil which flows in between the wall of the envelope part 11 and of the part 14 and flows off again in a centric manner.

The effect of the invention is based on the fact that the radiator dimensions, and hence also the weight, are substantially reduced. The installation of such a radiator in medical x-ray apparatus is thereby facilitated and, in specific instances, spatially possible at all for the first time. In addition, the lesser radiator weight leads to cost savings for the movement and support-mounting of the support arms or suspensions necessary for the provided x-ray radiator.

For the purpose of ray-generation a high voltage is applied between the anode 2 and the cathode 3. The high voltage generator is electrically connected to the cathode 3, for example, via line 17, and is electrically connected to the anode 2 via a contact pin 18. The contact pin 18 is in electric connection with the anode via an annular U-shaped metal part 19 (e.g. of the same material as part 8), and the parts 8, 7, 6, so that an electron current as indicated at 20 is directed from the cathode 3 to the anode 2. Through deceleration of the cathode ray beam 20, x-rays result in a known fashion which can emerge from the tube in the form of a beam 21. In an actual embodiment, parts such as 4 through 14 are each symmetrical about the central axis of rotation.

On the right side of FIG. 1 by means of a line 22, a modified embodiment of the anode 2 is separately illustrated which as an actual embodiment would also be symmetrical with respect to the axis of rotation. The sole major difference is that the layer 5, illustrated at the left side of FIG. 1, is arranged as a layer 5' in the manner customary in the case of anode plates. An electron beam 20' issuing from a cathode 3' then releases an x-ray beam 21' which emerges from the lateral wall of the envelope 1.

Figure 2:
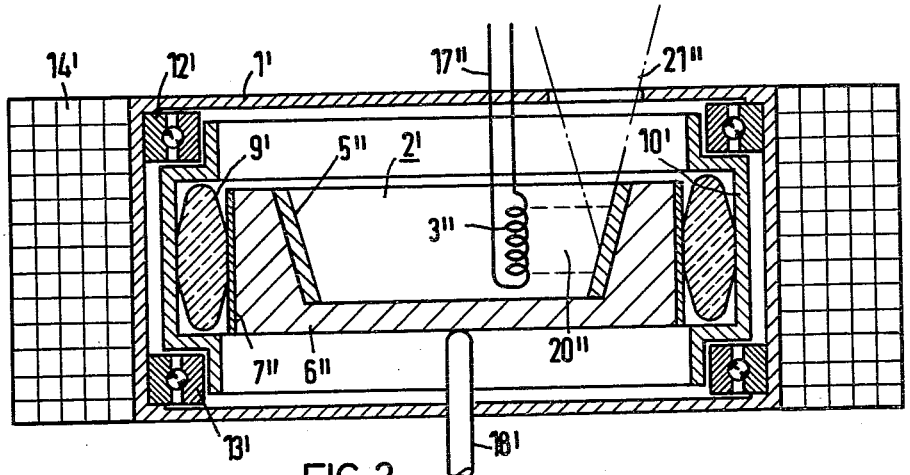

In the embodiment illustrated in FIG. 2, the component parts 14' of the magnetic bearing, which also serves as stator, are disposed on the peripheral exterior side of the envelope 1'. Since this relates only to an arrangement of the parts present in FIG. 1, which arrangement is altered in the geometric construction, the designations are merely provided with one or two dashes for the purpose of being able to distinguish them from those of FIG. 1. Except for the peripheral arrangement of the coils and stator component 14', the main difference resides in a crucible-shaped design of the part 6'' (consisting of Mo or graphite) of the anode 2' and in the arrangement of the cathode 3'' in the interior of the space of the crucible-shaped anode 2'. The remaining changes result from the peripheral arrangement of bearings and drive motor. The tubular section 7'', the ceramic section 9' and the bearing support 10' are here disposed on the exterior wall of the cruicible-shaped member 6''. The collection bearing 12' and 13' are disposed at the ends of the lateral wall of which the end faces of the envelope 1' lie. The x-ray beam 21'' issues from the one end face of the envelope 1' in a manner corresponding to the beam 21 of FIG. 1.

It will be apparent that many modifications and variations may be effected without departing from the scope of the novel concepts and teachings of the present invention.

In each embodiment, the electrical contact pin 18, 18' may be aligned with the axis of rotation of the anode, and the associated parts may provide a suitable conductive path to the electron beam defining electrode of the anode.

The sections 10 and 10' may be of a suitable material so as to act as the principal rotor part, forming an induction motor in conjunction with the stator windings of component 14.

An example of a rotary anode x-ray tube with a magnetic bearing for the anode is found in U.S. Pat. No. 4,167,671 issued Sept. 11, 1979. (See for example column 5 of this U.S. patent, lines 12 to 27, column 6, lines 3 to 7, and FIGS. 1 and 2 of the U.S. patent, components 7 to 13.)

A rotary drive for a rotary anode x-ray tube is shown at 6, 18 and 19 in FIGS. 1 and 2 of said U.S. Pat. No. 4,167,671. See also U.S. Ser. No. 227,996 filed Jan. 23, 1981.

Vacon is a sealing alloy containing 28% nickel, 23% of cobalt and the rest iron. The necessary properties are a coefficient of thermal expansion near that of the ceramic material of the part 9. Other necessary properties are to be electrically conductive and to be magnetizable (with low retentivity). A publication on this material is a leaflet "Firmenzeitschrift", "Einschemlzlegierungen Vacon, Vaconit" Ausgabe 3 (1974) of Vacuumschmelz GMBH, 645 Hanau, Germany Gruener Weg 37.

The metal part 19 can be welded to the other metal parts or soldered. The graphite part 6 can be soldered to the part 2 by zirconium and the ceramic part 9 or 9' can be soldered to adjoining parts by silver.

We claim as our invention:

1. A rotary anode x-ray tube comprising a tube wall, an annular anode mounted for rotation about a central axis, motor means comprising a stator and rotor on opposite sides of the tube wall, the annular anode as well as the stator and the rotor being disposed concentrically inside is free of any shaft, and which has a rotor cylindrical surface at the side of said rotor sleeve toward said annular anode, bearing means for directly supporting the rotor sleeve itself, and the annular anode having an anode annular surface concentric with said central axis, the central part of said rotor cylindrical surface being connected with said anode annular surface to provide a supporting and driving coupling between said rotor and said annular anode, said annular anode surrounding said rotor sleeve and said stator being inside said rotor.

2. A rotary anode x-ray tube according to claim 1, characterized in that the motor means is surrounded by the annular anode.

3. A rotary anode x-ray tube according to claim 2, characterized in that the space containing the stator receives a coolant.

4. A rotary anode x-ray tube according to claim 3, characterized by means providing a through-flow path for the coolant which is delivered between the tube wall and the stator and which is centrally carried away.

5. A rotary anode x-ray tube according to claim 1, characterized in that means for electrically contacting of the anode comprises a central contact.

6. A rotary anode x-ray tube according to claim 1, characterized in that the anode has an annular anode member and a ceramic ring, and that the stator of the motor means is disposed on the opposite side of the ceramic ring from the annular anode member, said ceramic ring being connected at respective opposite sides thereof with the central part of said rotor cylindrical surface and with said anode annular surface.

7. A rotary anode x-ray tube according to claim 1, characterized in that said bearing means comprise a magnetic bearing for mounting the anode.

8. A rotory anode x-ray tube comprising a tube wall, an annular anode mounted for rotation about a central axis, motor means comprising a stator and rotor on opposite sides of the tube wall, the annular anode as well as the stator and the rotor being disposed concentrically inside one another, the rotor being in the form of a rotor sleeve which is free of any shaft, and which has a rotor cylindrical surface at the side of said rotor sleeve toward said annular anode, bearing means for directly supporting the rotor sleeve itself, and the annular anode having an anode annular surface concentric with said central axis, the central part of said rotor cylindrical surface being connected with said anode annular surface to provide a supporting and driving coupling between said rotor and said annular anode, the annular anode being inside said rotor sleeve, said rotor being inside said stator.

9. A rotary anode x-ray according to claim 8, characterized in that the anode has a ceramic ring, and that the stator of the motor means is disposed on the opposite side of the ceramic ring from the annular anode member, said ceramic ring being connected at respective opposite sides thereof with the central part of said rotor cylindrical surface and with said anode annular surface.

* * * * *